US009228715B2

(12) United States Patent
Wong et al.

(10) Patent No.: US 9,228,715 B2
(45) Date of Patent: Jan. 5, 2016

(54) HYBRID CANOPY LIGHTING FOR OPTIMUM LIGHT BEAM SHAPING

(75) Inventors: Kum Soon Wong, Kuala Lumpur (MY); Kheng Leng Tan, Gelugor (MY); Chuan Hoe Chan, Perak (MY)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 13 days.

(21) Appl. No.: 13/402,293

(22) Filed: Feb. 22, 2012

(65) Prior Publication Data

US 2013/0215611 A1 Aug. 22, 2013

(51) Int. Cl.

| | |
|---|---|
| ***F21V 5/00*** | (2015.01) |
| ***F21V 7/00*** | (2006.01) |
| *F21Y 105/00* | (2006.01) |

(52) U.S. Cl.

CPC ..... *F21V 7/0083* (2013.01); *F21V 5/007* (2013.01); *F21Y 2105/001* (2013.01)

(58) Field of Classification Search

CPC ..... F21Y 2105/001; F21V 5/007; F21V 7/00
USPC ..... 362/545, 225, 236, 237, 240, 241, 247, 362/249.01, 249.02, 296.01, 346
See application file for complete search history.

(56) References Cited

U.S. PATENT DOCUMENTS

| | | | | |
|---|---|---|---|---|
| 2003/0161152 | A1 | 8/2003 | Jesurun et al. | |
| 2007/0139910 | A1* | 6/2007 | Gosis et al. | 362/96 |
| 2009/0040306 | A1* | 2/2009 | Foote et al. | 348/148 |
| 2009/0257224 | A1* | 10/2009 | Huang et al. | 362/235 |
| 2010/0110671 | A1* | 5/2010 | Gordin et al. | 362/228 |
| 2011/0038151 | A1* | 2/2011 | Carraher et al. | 362/242 |
| 2011/0194281 | A1* | 8/2011 | Josefowicz et al. | 362/235 |
| 2011/0235186 | A1* | 9/2011 | Blum et al. | 359/665 |

FOREIGN PATENT DOCUMENTS

| | | | |
|---|---|---|---|
| CN | 201255357 | Y | 6/2009 |
| CN | 201302101 | | 9/2009 |
| CN | 102003630 | | 4/2011 |
| CN | 102245964 | | 11/2011 |
| JP | 2011028959 | A | 2/2011 |
| KR | 20110113690 | A | 10/2011 |
| TW | 201202764 | | 1/2012 |
| WO | WO 2011/136640 | A2 | 11/2011 |

OTHER PUBLICATIONS

Kingslake, Rudolf, and R. Barry. Johnson. Introduction. Lens Design Fundamentals. London: Academic, 2010. 227-54. Print.*

Official Action for China Patent Application No. 201310056214.6, dated Apr. 3, 2015 9 pages.

* cited by examiner

*Primary Examiner* — Sean Gramling
*Assistant Examiner* — Gerald J Sufleta, II

(57) ABSTRACT

A lighting system and method are disclosed. Specifically, the lighting system includes a hybrid canopy that can provide an optimum light beam shape for a number of different lighting applications. The hybrid canopy is equipped with lighting clusters of different types, thereby enabling a broader beam output without sacrificing beam intensity or brightness.

19 Claims, 5 Drawing Sheets

HYBRID CANOPY LIGHTING FOR OPTIMUM LIGHT BEAM SHAPING

FIELD OF THE DISCLOSURE

The present disclosure is generally directed toward light sources.

BACKGROUND

Light Emitting Diodes (LEDs) have many advantages over conventional light sources, such as incandescent, halogen and fluorescent lamps. These advantages include longer operating life, lower power consumption, and smaller size. Consequently, conventional light sources are increasingly being replaced with LEDs in traditional lighting applications. As an example, LEDs are currently being used in flashlights, camera flashes, traffic signal lights, automotive taillights and display devices. LEDs are also becoming more prevalent in residential, commercial, and industrial lighting applications.

Canopy lighting is one type of lighting commonly used in commercial and industrial lighting applications. Currently available LED-based canopy lighting employs monolithic lighting techniques. Specifically, canopy lighting often employs multiple sub-units and it is the current practice to use the same type of sub-units within a single lighting canopy. Specifically, the sub-units often have the same distribution of LEDs and use the same type of reflector cup for every LED. This rigid design approach does not afford a design freedom and limits a canopy's usefulness across multiple lighting applications.

BRIEF DESCRIPTION OF THE DRAWINGS

The present disclosure is described in conjunction with the appended figures.

DETAILED DESCRIPTION

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

Although certain components will be described as being constructed with certain materials, those skilled in the arts will appreciate that any type of suitable material used for one component may be used for other components. For example, any one of the components described herein may be constructed of metal, steel, alloys, plastic (e.g., PET, PTFE, PVC, etc.), ceramic, glass, wood, rubber, or combinations thereof.

Figure 1:
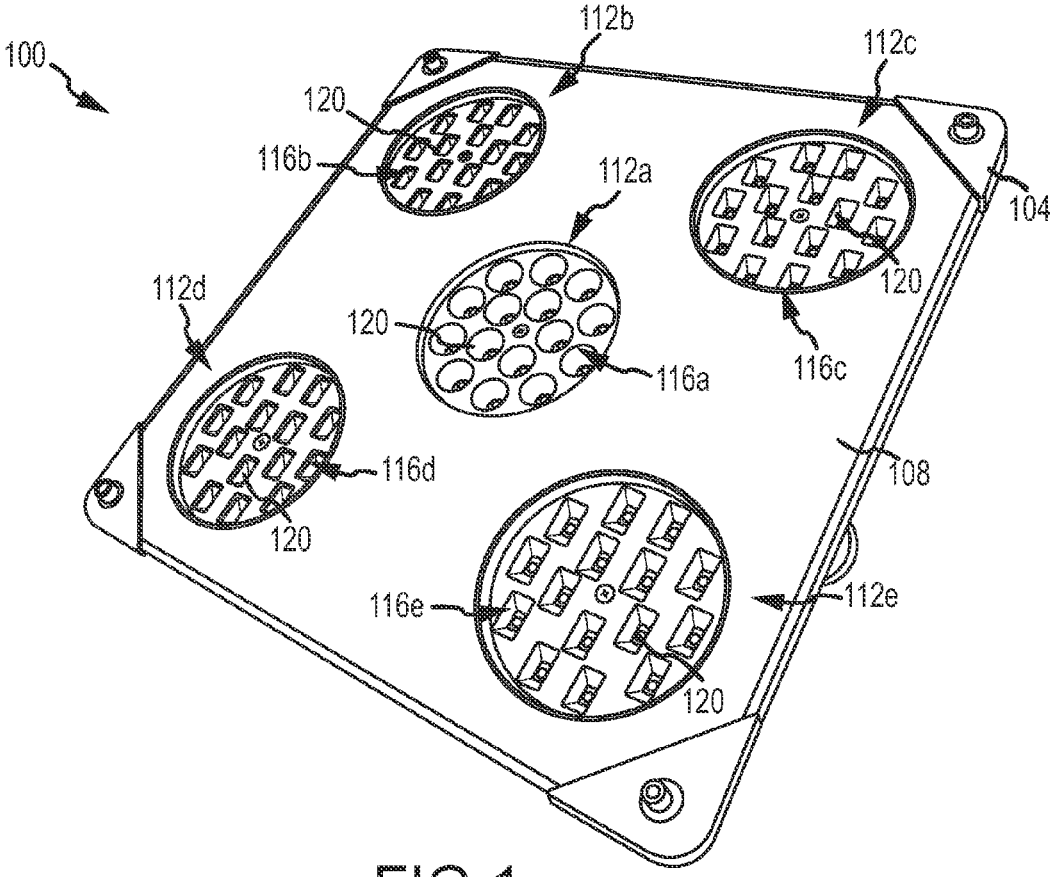
FIG. 1 is an isometric view of a first lighting canopy in accordance with embodiments of the present disclosure.

With reference initially to FIG. 1, a first lighting canopy 100 will be described in accordance with embodiments of the present disclosure. The first lighting canopy 100 may also be referred to herein as a luminescence. The first lighting canopy 100 may include one or more components that enable the first lighting canopy 100 to provide light in a number of different lighting applications (e.g., residential, industrial, commercial, etc.). Furthermore, various components of the first lighting canopy 100 may be interchangeable with other similar types of components that will be described in further detail hereinafter. In particular, the components of the first lighting canopy 100 may be modular in nature and are, therefore, easily adaptable to a number of different lighting applications. In some embodiments, the first lighting canopy 100 may be considered a hybrid lighting canopy because it is capable of providing light sources of multiple types (e.g., light sources having different lighting properties).

Non-limiting example components that may be included in the first lighting canopy 100 include a support structure 104, a cover 108, and a plurality of lighting clusters 116*a*-N (where N is greater than or equal to one). In the embodiment depicted in FIG. 1, the first lighting canopy 100 comprises five lighting clusters 116*a-e*. The lighting clusters 116*a-e* may each be positioned on the support structure 104 so that the lighting clusters 116*a-e* are evenly distributed across the major surface of the first lighting canopy 100.

In some embodiments, the cover 108 is provided with a plurality of recesses or holes 112*a*-N (where N is greater than or equal to one). In the embodiment depicted in FIG. 1, the cover 108 comprises five recesses 112*a-e*, where each recess is configured to receive or fit over a different lighting cluster 116*a-e*, respectively. The cover 108 may be made out of any type of material such as polymers, glass, ceramics, etc. The cover 108 is used both to improve the aesthetic nature of the first lighting canopy 100 as well as cover various electronic components of the first lighting canopy 100 that provide electrical current to the light sources contained within the lighting clusters 116*a-e*.

As can be seen in FIG. 1, one or more of the lighting clusters may have one or more different light-distributing properties from others of the lighting clusters. In the example depicted in FIG. 1, the first lighting cluster 116*a* comprises a plurality of reflector cups 120 that are different in shape than the reflector cups 120 in the other lighting clusters 116*b-e*. More specifically, the reflector cups 120 of the first lighting cluster 116*a* are configured with a circular shape whereas the reflector cups 120 of the other lighting clusters 116*b-e* are configured with a rectangular shape. In some embodiments, the varied nature of the reflector cups enables the hybrid first lighting canopy 100 to provide a more evenly distributed amount of light without sacrificing beam intensity.

Although the first lighting cluster 116*a* is depicted as having reflector cups of a first type that are different from the reflector cups of the other lighting clusters 116*b-e*, it should be appreciated that the lighting clusters may have other properties that are different to allow the lighting clusters to provide different beam shapes, thereby increasing the ways in which light is distributed by the lighting canopy 100. As some non-limiting examples, one of the lighting clusters 116 may have a plurality of reflector cups of a first type (e.g., narrow angle reflector cups designed to emit light beams between 30 degrees and 60 degrees, wide angle reflector cups designed to emit light beams between 90 degrees and 120 degrees, oval shaped reflector cups, rectangular shaped reflector cups, square shaped reflector cups, multi-shaped reflector cups, no reflector cups) while another of the lighting clusters 116 may have a plurality of reflectors of a second type (e.g., any of the above-described types of reflector cups but different from the first type).

Other light-shaping aspects of the clusters may vary in accordance with embodiments of the present disclosure. For instance, one of the lighting clusters 116 may have beam-shaping lenses of a first type whereas another of the lighting clusters 116 may have beam-shaping lenses of a second type. The first type may vary from the second type based on one or more of shape (e.g., domed, flat, multi-focal, etc.), material (e.g., epoxy, silicone, a hybrid of silicone and epoxy, phosphor, a hybrid of phosphor and silicone, an amorphous polyamide resin or fluorocarbon, glass, plastic, combinations thereof), tint/color, height, width, etc. Another light-shaping aspect that may vary from lighting cluster to lighting cluster is the number of light sources/reflector cups provided in different types of lighting clusters. For instance, one type of lighting cluster may have a first number of light sources/reflector cups whereas a second type of lighting cluster may have a second number of light sources/reflector cups.

Further still, while the first lighting canopy 100 is depicted as having two different types of lighting clusters, it should be appreciated that the number of different lighting clusters may vary from anywhere between 2 and N. In other words, the first lighting canopy 100 (and any other lighting canopy described herein) may comprise two different types of lighting clusters up to N different types of lighting clusters. Using the example of FIG. 1, there may be 2, 3, 4, or 5 different types of lighting clusters without departing from the scope of the present disclosure.

Figure 2:
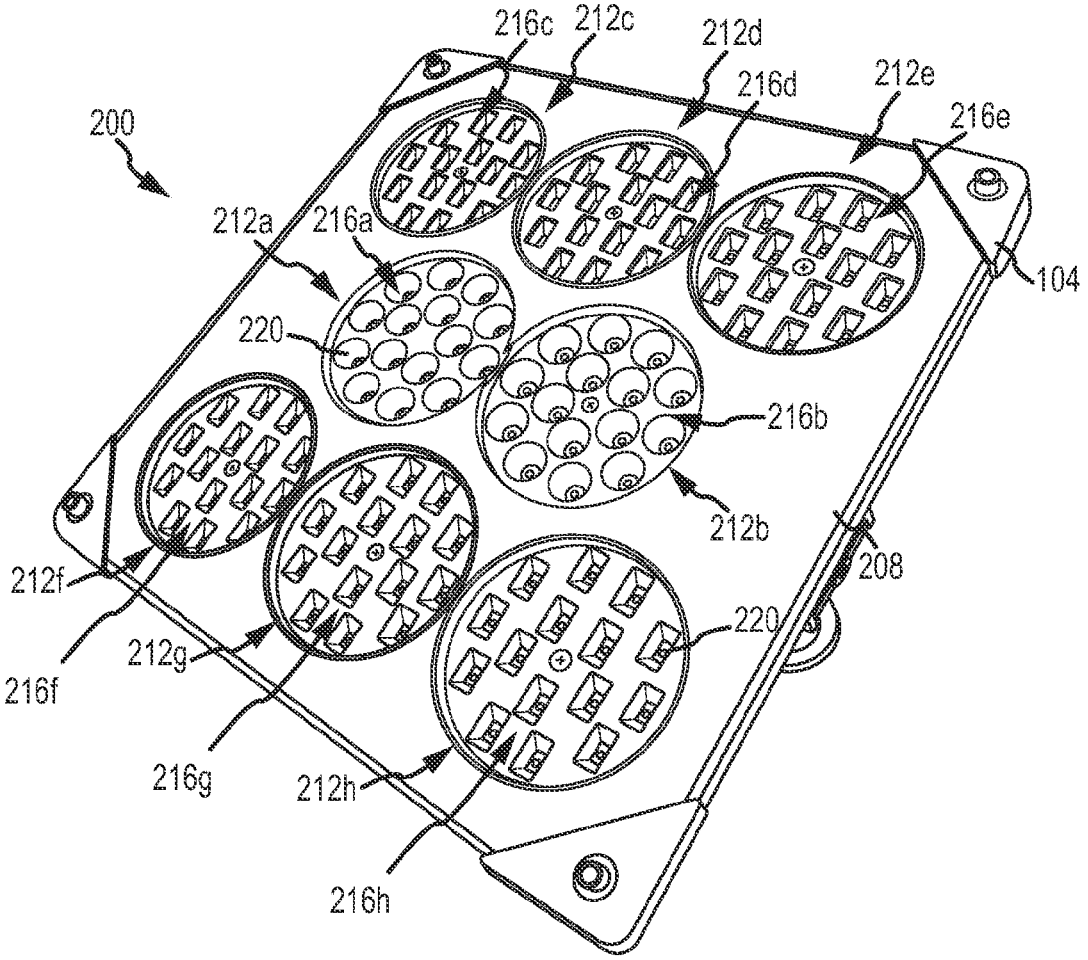
FIG. 2 is an isometric view of a second lighting canopy in accordance with embodiments of the present disclosure.

With reference now to FIG. 2, a second lighting canopy 200 will be described in accordance with at least some embodiments of the present disclosure. The second lighting canopy 200 may be similar or identical to the first lighting canopy 100 in that both canopies have a support structure 104 that mechanically supports a plurality of lighting clusters as well as provides electrical current to light sources in the lighting clusters. In fact, the second lighting canopy 200 may be the first lighting canopy 100 but with a different cover 208 that has a different number of recesses 212.

In some embodiments, the second lighting canopy 200 comprises a cover 208 with eight recesses or holes 212*a-h*. Each recess 212*a-h* is configured to receive or fit around a different lighting cluster 216*a-h*. As with the first lighting canopy 100, the second lighting canopy 200 may have lighting clusters of different types. The non-limiting example of FIG. 2 shows that a first and second type of lighting cluster are provided. The first and second lighting clusters 216*a*, 216*b* are of a first type and have reflector cups 220 of a first type. The other lighting clusters 216*c-h* are of a second type and have reflector cups 220 of a second type. Although the lighting clusters depicted in FIG. 2 vary based on reflector cup type, it should be appreciated that the way in which lighting clusters vary can be based on one or more of reflector cup properties, lens properties, material properties, number of light sources (e.g., LEDs), and combinations thereof.

Figure 3:
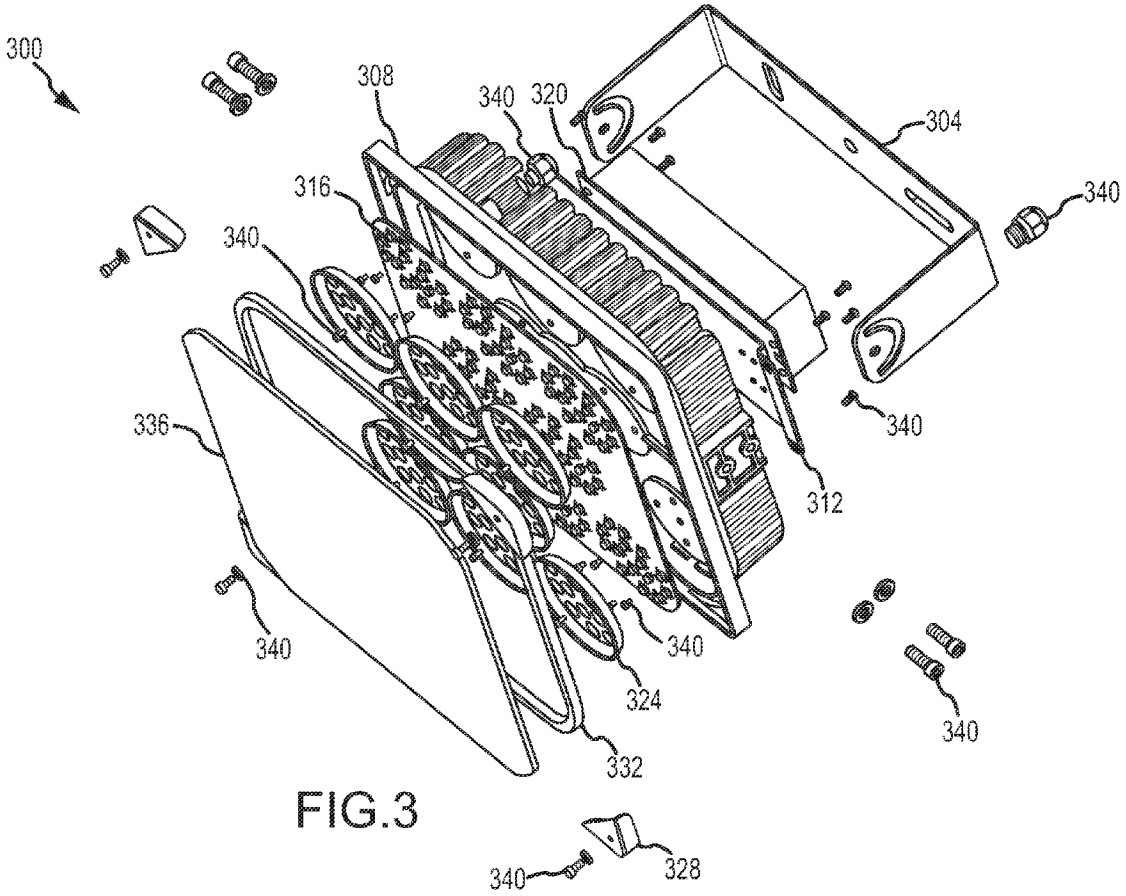
FIG. 3 is an exploded view of a third lighting canopy in accordance with embodiments of the present disclosure.

With reference now to FIG. 3, a third lighting canopy 300 will have its component parts described in further detail. It should be appreciated that the details described herein about the component parts of the third lighting canopy 300 may apply to component parts of the first or second lighting canopy 100, 200. Moreover, any aspect described in connection with the first or second lighting canopies 100, 200 may apply to the third lighting canopy 300.

FIG. 3 shows in particular how the components of the lighting canopy 300 may be put together. It also depicts that various components of the lighting canopy 300 are modular and, therefore, may be replaced with other different components without completely replacing the entire lighting canopy 300. In some embodiments, the components that may be included in the lighting canopy 300 include, without limitation, a mounting bracket 304, a body 308, a bracket plate 312, a Printed Circuit Board (PCB) 316, a power supply 320, a plurality of reflector cup clusters 324, a plurality of corner protectors 328, a seal 332, a cover 336, and a plurality of fasteners 340.

The mounting bracket 304 may be configured to attach to sides of the body 308 via a plurality of fasteners 340. The fasteners 340 may include one or more of screws, bolts, nuts, clasps, latches, friction fittings, tabs, flanges, or combinations thereof. The mounting bracket 304 may be constructed of metal, steel, alloys, or the like and may be used to mount the lighting canopy 300 on a wall, ceiling, or other surface that enables the lighting canopy 300 to direct light within an area to be light. The mounting bracket 304 may comprise a number of arcuate slots on the ends that interface with the fasteners 340 and body 308, thereby enabling the body 308 and other parts connected thereto to be rotatably connected to the mounting bracket 304.

The body 308 may comprise heat-distributing components (e.g., one or more heat sinks) as well as mechanical features that enable the body 308 to connect to the mounting bracket 304, the bracket plate 312, the PCB 316, the seal 332, and the cover 336. In some embodiments, the body 308 also comprises wires and/or circuitry that carries current from the power supply 320 to the PCB 316. More specifically, the power supply 320 may comprise an AC-to-DC power converter and various other power-conditioning circuits that enable the power supply 320 to connect to an external AC power source, but provide DC power to the light sources (e.g., LEDs) mounted on the PCB 316. Alternatively, the power supply 320 may comprise a DC power source that provides DC power to the light sources on the PCB 316.

As discussed in connection with FIGS. 1 and 2, a lighting cluster may include a plurality of light sources as well as a reflector cup cluster 324 that surrounds the plurality of light sources and shapes light emitted by the plurality of light clusters. As can be seen in FIG. 3, the light sources of a lighting cluster may be mounted on the PCB 316. The light sources may correspond to LEDs. Any type of known LED may be mounted to the PCB 316 including, without limitation, Surface Mount Technology (SMT) LED, through mount LEDs, or combinations thereof. The pattern in which the light sources are mounted on the PCB 316 may correspond to the same pattern of reflector cups in a reflector cup cluster 324. The reflector cup clusters 324 may be interchangeable and modular, which means that a reflector cup cluster 324 of one type may be replaced with a reflector cup cluster 324 of another type by simply removing the cover 336, removing the fasteners 340 that mount the reflector cup cluster 324, removing the reflector cup cluster 324, then mounting a different reflector cup cluster 324 to the PCB 316 with the fasteners 340.

In some embodiments, the reflector cup clusters 324, which are modular, may also have a different number of reflector cups. In some embodiments, this may require the light sources to also be modular or movable on the PCB 316. Alternatively, a reflector cup cluster 324 may only replace another reflector cup cluster 324 if it has the same number or greater number of reflector cups. If the replacement reflector cup cluster 324 comprises a greater number of reflector cups, then either the additional reflector cups may be empty (e.g., without a light source) or additional light sources may be mounted to the PCB 316 where the reflector cups will be positioned.

As can also be seen in FIG. 3, the reflector cup clusters 324 are configured to be mounted directly onto the PCB 316 after the light sources are in place. This means that the reflector cups of the reflector cup clusters 324 may have holes or recesses at their bottom surface that fit around the light source and mate with the top surface of the PCB 316.

In some embodiments, the PCB 316 is a conventional PCB 316 that comprises composites that are manufactured in accordance with the FR-4 and/or G-10 specification. It should be appreciated, however, that the PCB 316 may be rigid or flexible without departing from the scope of the present disclosure.

The seal 332 may fit around the PCB 316 and protect various electrical components on both surfaces of the PCB 316 from environmental conditions. In particular, the seal 332 may mate with the outer edge of the body 308 and after the cover 336 is fastened to the body 308 with fasteners 340, the cover 336, seal 332, and body 308 may protect the PCB 316 and its electrical components from harmful moisture and other damaging conditions. In some embodiments, the seal 332 is made of silicone or rubber, much like a rubber gasket. The cover 336 may comprise a suitable number of recesses or holes to accommodate the reflector cup clusters 324. If the light-distributing properties of the light canopy 300 are to be altered, then it may be possible to replace one or more of the cover 336, reflector cup clusters 324, light sources, or PCB 316 with a different type of the same component.

Figure 4:
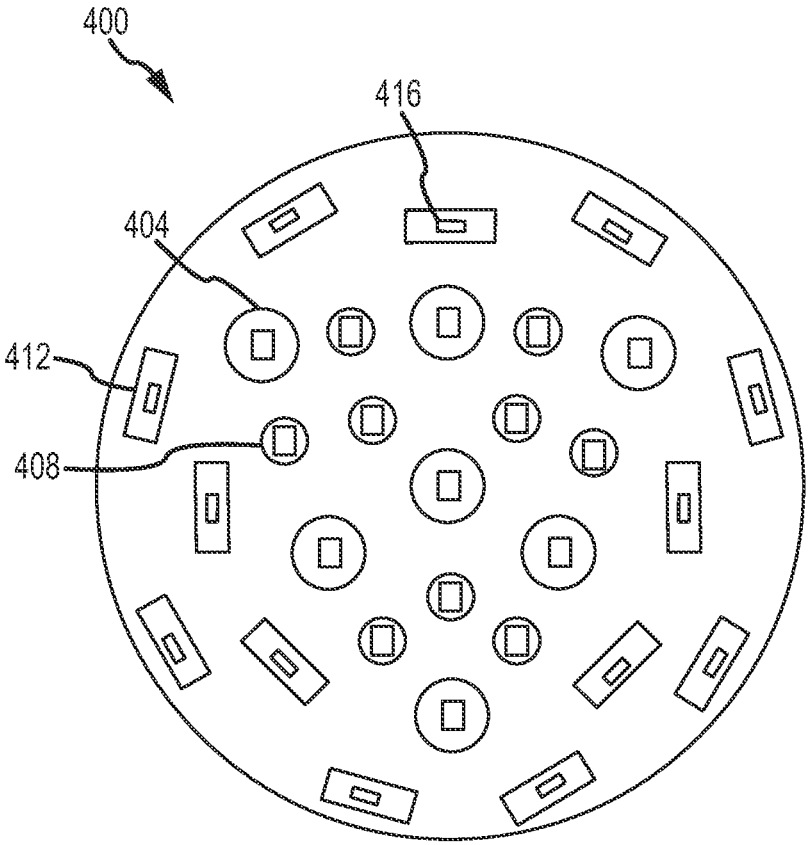
FIG. 4 is a top view of a lighting cluster in accordance with embodiments of the present disclosure.

With reference now to FIG. 4, another type of lighting cluster 400 will be described in accordance with at least some embodiments of the present disclosure. The lighting cluster 400 may be used in any of the above-described lighting canopies 100, 200, 300. The lighting cluster 400 may be configured with a number of different types of reflector cups. Specifically, the lighting cluster 400 may comprise a first reflector cup type 404, a second reflector cup type 408, and a third reflector cup type 412. Although three reflector cup types are depicted on the lighting cluster 400, it should be appreciated that a lighting cluster used in accordance with embodiments of the present disclosure may have a greater or lesser number of different reflector cup types. Specifically, any lighting canopy described herein may be provided with one, two, three, four, five, six, seven, eight, or more different types of reflector cups without departing from the scope of the present disclosure. The different reflector cup types may be different across one or more of size, shape, height/depth, reflectivity, material, lenses within the reflector cup, and the like. Accordingly, although the reflector cup types 404, 408, 412 are depicted as having different sizes and shapes, it should be appreciated that a lighting cluster may be provided with reflector cups of the same sizes and shapes, but with different reflective materials. For instance, some reflector cups may be coated with a highly-reflective material (e.g., metal or plastic coated with white paint) whereas other reflector cups may be less reflective (e.g., plastic coated with black or absorbing paint).

In some embodiments, each reflector cup type 404, 408, 412 is configured to receive a light source 416. In some embodiments, the light sources 416 may be different for different reflector cups. Specifically, some light sources 416 may be brighter or higher intensity than other light sources 416. In other embodiments, some light sources 416 may be different shapes/sizes than other light sources 416.

The lighting cluster 400, in some embodiments, may be made of metallic material to increase the reflectivity of each reflector cup type. Alternatively, the lighting cluster 400 may be manufactured of plastic or the like and may be coated with metallic or highly-reflective paint.

Figure 5:
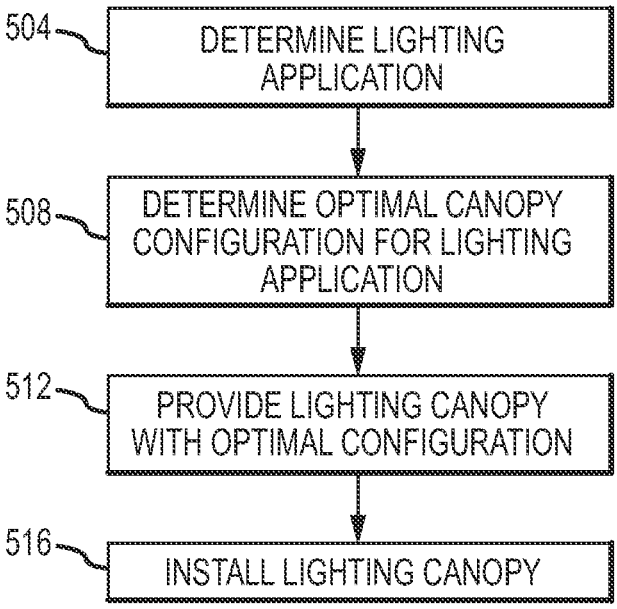
FIG. 5 is a flow diagram depicting a lighting method in accordance with embodiments of the present disclosure.

With reference now to FIG. 5, a lighting method will be described in accordance with embodiments of the present disclosure. The method is initiated by determining a lighting application or area to be light (step 504). As noted above, the lighting application may vary from location to location and each location may require different lighting needs. The lighting needs may depend upon ambient lighting conditions, light requirements, and the like.

Based on the lighting application, an optimal canopy configuration is determined (step 508). The optimal canopy configuration may require lighting clusters of a single type. However, many lighting applications may benefit from the use of a hybrid lighting canopy that comprises lighting clusters of different types.

One or more lighting canopies are then configured with the determined optimal configuration (step 512). Specifically, the lighting canopy may be provided with a number of different lighting clusters that may or may not be of different types. In some embodiments, one or more of the lighting canopies 100, 200, 300, or a lighting canopy having one or more lighting clusters with different light-directing features may be used. Since the lighting canopies may be configured to have modular reflector cups, the reflector cups may be interchanged to achieve the optimal lighting canopy design.

The optimal lighting canopy is then installed in the lighting application area (step 516). The lighting canopy may be installed by mounting the lighting canopy to a wall, ceiling, or other surface with the mounting bracket 304 and one or more fasteners 340.

Specific details were given in the description to provide a thorough understanding of the embodiments. However, it will be understood by one of ordinary skill in the art that the embodiments may be practiced without these specific details. In other instances, well-known circuits, processes, algorithms, structures, and techniques may be shown without unnecessary detail in order to avoid obscuring the embodiments.

While illustrative embodiments of the disclosure have been described in detail herein, it is to be understood that the inventive concepts may be otherwise variously embodied and employed, and that the appended claims are intended to be construed to include such variations, except as limited by the prior art.

What is claimed is:

1. A lighting system, comprising:

a hybrid lighting canopy that includes:

a Printed Circuit Board (PCB) having a plurality of light sources connected thereto;

a first reflector cup cluster having a first set of substantially circular reflector cups, the first reflector cup cluster being positioned relative to a first surface of the PCB so that each reflector cup in the first set of reflector cups surrounds a light source in a first set of light sources from the plurality of light sources; and a plurality of additional reflector cup clusters surrounding the first reflector cup cluster, wherein each of the plurality of additional reflector cup clusters are non-circular and are positioned relative to the first surface of the PCB so that each reflector cup in the plurality of additional reflector cup clusters surrounds a light source mounted on the PCB, wherein at least one reflector cup in the first set of reflector cups comprises a lens having a first shape and wherein at least one reflector cup in the plurality of additional reflector cups comprises a lens having a second shape.

2. The system of claim 1, wherein the reflector cups in the plurality of additional reflector cup dusters are oval.

3. The system of claim 1, wherein the at least one reflector cup in the first set of reflector cups comprises a different reflectivity than the at least one reflector cup in the plurality of additional reflector cups.

4. The system of claim 1, wherein the at least one reflector cup in the first set of reflector cups comprises a different lens than the at least one reflector cup in the plurality of additional reflector cups.

5. The system of claim 4, wherein the at least one reflector cup in the first set of reflector cups comprises a lens made of a first material and wherein the reflector cups in the plurality of additional reflector cup clusters each comprise a lens made of a second material that is different from the first material.

6. The system of claim 1, wherein the first set of reflector cups comprises narrow-angle reflector cups to focus a beam of light and wherein the second set of reflector cups comprises wide-angle reflector cups.

7. The system of claim 1, wherein the first set of reflector cups comprises both a first type of reflector cup and a second type of reflector cup that is different from the first type of reflector cup by at least one of size, height, depth, reflectivity, and coating material.

8. The system of claim 1, wherein the first reflector cup cluster is interchangeable with one of the plurality of additional cup clusters.

9. A hybrid lighting canopy, comprising:

a substantially planar Printed Circuit Board (PCB);

a first lighting cluster having a first set of reflector cups, each of which are positioned around a light source from a first set of light sources, respectively, each of which are mounted to the substantially planar PCB, and each of which are substantially circular in shape;

a second, third, fourth, and fifth lighting cluster having a second, third, fourth, and fifth set of reflector cups, respectively, each of which are positioned around a light source mounted to the substantially planar PCB, each of which are non-circular in shape, and wherein the second, third, fourth, and fifth lighting cluster substantially surround the first lighting cluster;

wherein the first set of reflector cups comprise at least one light-directing property that is different from the second set of reflector cups due to their circular shape;

wherein the second, third, fourth, and fifth lighting clusters comprise the same perimeter shape and size as the first lighting cluster; and wherein the variation between the first set of reflector cups and the second, third, fourth, and fifth sets of reflector cups enables the hybrid lighting canopy to provide evenly distributed light without sacrificing beam intensity.

10. The hybrid lighting canopy of claim 9, wherein the second, third, fourth, and fifth set of reflector cups are substantially oval shaped.

11. The hybrid lighting canopy of claim 10, wherein the first set of reflector cups produce a narrow-angle beam of light and wherein the second, third, fourth, and fifth sets of reflector cups produce a wide-angle beam of light.

12. The hybrid lighting canopy of claim 9, wherein the second, third, fourth, and fifth set of reflector cups are substantially rectangular shaped.

13. The hybrid lighting canopy of claim 9, wherein the first lighting cluster is positioned at substantially a center of the PCB and wherein the second, third, fourth, and fifth lighting clusters are symmetrically positioned around the first lighting cluster.

14. The hybrid lighting canopy of claim 9, wherein the first set of reflector cups comprise a highly-reflective material for a reflective surface and wherein the second, third, fourth, and fifth sets of reflector cups comprise at least one of plastic, black paint, and a light-absorbing paint to reduce a reflectivity thereof relative to the first set of reflector cups.

15. A lighting system, comprising:

a hybrid lighting canopy that includes:

a Printed Circuit Board (PCB) having a plurality of light sources connected thereto;

a first reflector cup cluster having a first set of substantially circular reflector cups, the first reflector cup cluster being positioned relative to a first surface of the PCB so that each reflector cup in the first set of reflector cups surrounds a light source in a first set of light sources from the plurality of light sources;

a plurality of additional reflector cup clusters surrounding the first reflector cup cluster, wherein each of the plurality of additional reflector cup clusters are non-circular and are positioned relative to the first surface of the PCB so that each reflector cup in the plurality of additional reflector cup clusters surrounds a light source mounted on the PCB, wherein a variation between the first set of reflector cups and the plurality of additional reflector cup clusters enables the hybrid lighting canopy to provide evenly distributed light without sacrificing beam intensity; and wherein the first reflector cup cluster is interchangeable with one of the plurality of additional cup clusters.

16. The system of claim 15, wherein the reflector cups in the plurality of additional reflector cup clusters are oval.

17. The system of claim 15, wherein at least one reflector cup in the first set of reflector cups comprises a different reflectivity than at least one reflector cup in the plurality of additional reflector cups.

18. The system of claim 16, wherein at least one reflector cup in the first set of reflector cups comprises a different lens than at least one reflector cup in the plurality of additional reflector cups.

19. The system of claim 18, wherein the at least one reflector cup in the first set of reflector cups comprises a lens made of a first material and wherein the reflector cups in the plurality of additional reflector cup clusters each comprise a lens made of a second material that is different from the first material.

* * * * *